US006666952B2

(12) United States Patent
Dilts et al.

(10) Patent No.: US 6,666,952 B2
(45) Date of Patent: Dec. 23, 2003

(54) PAPER SIZING COMPOSITIONS AND METHODS

(75) Inventors: Kimberly C. Dilts, Beacon Falls, CT (US); Robert J. Proverb, Danbury, CT (US); David L. Dauplaise, Stamford, CT (US)

(73) Assignee: Bayer Chemicals Corporation, Pittsburgh, PA (US)

( * ) Notice: Subject to any disclaimer, the term of this patent is extended or adjusted under 35 U.S.C. 154(b) by 0 days.

(21) Appl. No.: 10/431,741

(22) Filed: May 6, 2003

(65) Prior Publication Data

US 2003/0205167 A1 Nov. 6, 2003

Related U.S. Application Data

(62) Division of application No. 09/573,373, filed on May 18, 2000, now Pat. No. 6,576,049.

(51) Int. Cl.[7] ..... C09D 7/12; C09D 191/00; D21H 21/00; D21H 17/71

(52) U.S. Cl. ..... 162/158; 162/164.1; 162/164.4; 162/173; 162/179; 106/219; 106/220; 106/222; 106/230; 106/238; 106/243; 106/244; 106/252; 106/285; 106/287.1; 106/287.2

(58) Field of Search ..... 106/219, 220, 106/222, 230, 238, 243, 244, 252, 285, 287.1, 287.2; 162/158, 164.1, 164.4, 173, 179

(56) References Cited

U.S. PATENT DOCUMENTS

| | | | | |
|---|---|---|---|---|
| 2,832,357 | A | 4/1958 | Powers | |
| 3,102,064 | A | 8/1963 | Wurzburg et al. | |
| 3,821,069 | A | 6/1974 | Wurzburg | |
| 3,968,005 | A | 7/1976 | Wurzburg | |
| 3,992,345 | A | 11/1976 | Dumas | |
| 4,040,900 | A | 8/1977 | Mazzarella et al. | |
| RE29,960 | E | 4/1979 | Mazzarella et al. | |
| 4,544,414 | A | 10/1985 | Kawatani et al. | |
| 4,657,946 | A | 4/1987 | Rende et al. | |
| 4,687,519 | A | 8/1987 | Trzasko et al. | |
| 4,711,671 | A | 12/1987 | Mazzarella et al. | |
| 4,728,366 | A | 3/1988 | Mazzarella et al. | |
| 4,747,910 | A | 5/1988 | Mazzarella et al. | |
| 4,832,792 | A | 5/1989 | Mazzarella et al. | |
| 4,859,244 | A | 8/1989 | Floyd | |
| 5,483,078 | A | 1/1996 | Hermann et al. | |
| 5,510,003 | A | 4/1996 | Colasurdo et al. | |
| 5,759,249 | A | 6/1998 | Wasser | |
| 6,576,049 | B1 * | 6/2003 | Dilts et al. | 106/219 |

FOREIGN PATENT DOCUMENTS

| | | |
|---|---|---|
| CA | 1069410 | 1/1980 |
| GB | 2268941 | 1/1994 |
| JP | 54-11313 | 1/1979 |
| JP | 54-106610 | 8/1979 |
| JP | 61-47897 | 3/1986 |
| JP | 5-173287 | 7/1993 |

OTHER PUBLICATIONS

J.W. Davis et al., "A New Sizing Agent for Paper—Alkylketene Dimers", TAPPI, vol. 39, No. 1, (Jan. 1956), pp. 21–23.

E.W. Clark, "Possibilities of Application of Wool Fat in the Papier Industry", Paper, vol. 18 (1994), No month provided pp. 794–795 (with English Language Abstract).

K. Motiuk, "Wool Wax Acids: A Review", J. Am. Oil Chemists Soc., 1979, vol. 56, pp. 91–97 (SD&C Technical, (Feb. 1979) pp. 27–33).

K. Motiuk, "Wool Wax Alcohols: A Review", J. Am. Oil Chemists Soc., 1979, vol. 56, pp. 651–658 (SD&C Technical, (Jun. 1979), pp. 89–96).

G. Chen et al., "Optimizing the Emulsification and Sizing of Alkenyl Succinic Anhydride", Tappi Journal, (Aug. 1986) pp. 95–97.

R.E. Cates et al., "Alkyl Ketene Dimer Sizes", Chapter 2 in "The Sizing of Paper", 2nd Ed., W.F. Reynolds, Ed., TAPPI Press, (1989) No month provided pp. 33–50.

C.E. Farley et al., "Sizing with Alkenyl Succinic Anhydride," Chapter 3 in "The Sizing of Paper", 2nd Ed., W.F. Reynolds, Ed., TAPPI Press, (1989), No month provided pp. 51–62.

J.C. Roberts, "Neutral and Alkaline Sizing," in "Paper Chemistry", Blackie & Son, (1991), No month provided pp. 114–131.

* cited by examiner

*Primary Examiner*—David Brunsman
(74) *Attorney, Agent, or Firm*—Godfried R. Akorli; Diderico van Eyl

(57) ABSTRACT

This invention relates to paper sizing compositions comprised of at least one sizing agent selected from ASA, AKD and rosin where the at least one sizing agent is emulsified in water, at least one emulsion stabilizer, and from about 0.01% to about 15% by weight of at least one hydrophobic substance, based on the total weight of sizing agent present, provided that the hydrophobic substance is not highly alkoxylated. The sizing promotion efficiency of the paper sizing compositions, as determined by at least one method selected from the Cytec size testing method, the Hercules size testing method, and the Cobb size testing method, is greater than or equal to about 4. Exemplary hydrophobic substances include fatty acid esters, triglycerides, hydrocarbons, esters and/or amides derived from ASA, silicone oils, alcohols, and stearic anhydride. The invention also relates to methods for sizing paper products with these paper sizing compositions and paper or paperboard treated with these sizing compositions.

7 Claims, No Drawings

PAPER SIZING COMPOSITIONS AND METHODS

This application is a Divisional of Ser. No. 09/573,373 filed May 18, 2000 now U.S. Pat. No. 6,576,049.

TECHNICAL FIELD

The present invention relates to sizing compositions and methods of sizing paper. The sizing compositions of this invention comprise at least one hydrophobic substance which is not a sizing agent, at least one sizing agent selected from ASA, AKD and rosin where the sizing agent is emulsified in water, and at least one emulsion stabilizer.

BACKGROUND OF THE INVENTION

This invention relates to paper sizing, i.e., rendering paper more resistant to penetration by liquids, such as inks. The control of the penetration of liquids, such as aqueous inks, into paper and the water-resistance of paper are important properties of many grades of paper and for many applications. Control of ink penetration is important in writing and printing grades and, especially, for ink-jet printing. For example, good printing performance may require a limited amount of wetting by the ink but the rate of penetration of the ink into the sheet should be low.

Paper and paperboard are often sized with various sizing agents, such as alkyl and alkenyl succinic anhydride (hereafter "ASA"), alkyl and alkylene ketene dimers (hereafter "AKD"), rosin and rosin derivatives such as rosin soap, starch, sodium silicate, fluorocarbons, certain styrene-maleic anhydride copolymers and cyclic dicarboxylic acid anhydrides. Sizing can be accomplished by either internal sizing processes, which usually involve wet end addition, or surface sizing processes, which usually involve addition at the size press. For effective sizing of paper pulp, it is desirable that the sizing agent be uniformly distributed throughout the fibrous slurry of pulp. Therefore, sizing agents may be emulsified to a small particle size using an emulsion stabilizer and the aqueous sizing emulsion is then added to the pulp at the wet end of the papermaking process. Emulsion stabilizers commonly used to prepare sizing emulsions include, for example, cationic starches and cationic polymers.

Certain sizing agents, such as ASA and AKD which are reactive substances capable of forming chemical bonds to the paper surface, also tend to be reactive with water. Therefore, sizing emulsions comprising such materials may be prepared at a paper mill and added immediately to the wet end of the paper making process in order to minimize reactions between water and the sizing agent.

Aqueous emulsions comprising ASA as the sizing agent are described in U.S. Pat. No. 3,102,064 to Wurzburg et al. (hereafter "the '064 patent"). The ASA sizing emulsions disclosed in the '064 patent must additionally comprise either a cationic agent or an agent that is capable of disassociating to yield one or more cations. Cationic agents disclosed in the '064 patent are various cationic starch derivatives which can be prepared from a variety of starches including corn, tapioca and potato. However, these ASA sizing emulsions can cause various problems when used in making paper, including machine deposits and continuity problems in the form of press picking, felt filling, and poor cylinder vat consistency control.

U.S. Pat. No. 4,657,946 to Rende et al. (hereafter "the '946 patent") discloses aqueous ASA emulsions said to be improved over those of the '064 patent. The '946 patent discloses cationic water soluble vinyl addition polymers with molecular weights greater than about 10,000 and preferably below about 1,000,000 as emulsifiers or co-emulsifiers for ASA sizing emulsions. However, the sizing emulsions of the '946 patent suffer from a short shelf life and are prepared by mixing with an expensive high shear mixer.

U.S. Pat. Nos. 4,711,671 and 4,747,910 (hereafter "the '671 patent" and "the '910 patent", respectively) disclose shelf storable, self-emulsifying paper sizing reagents containing highly ethoxylated lanolin, i.e., at least about 15 moles of ethylene oxide per mole of lanolin. Each of these two patents discloses compositions containing between about 1 and 20 parts by weight ethoxylated lanolin with a composition containing about 1% ethoxylated lanolin showing the greatest improvement in storage stability. However, the disclosure in these references provide, at most, minimal sizing improvements (less than about a 9.5% increase in HST size after 1 month accelerated aging) over the control ASA emulsion.

U.S. Pat. Nos. 4,728,366 and 4,832,792 disclose shelf storable, self-emulsifying paper sizing reagents containing highly ethoxylated castor oil, i.e., at least about 5 moles of ethylene oxide per mole of castor oil. Each of these two patents discloses compositions containing between about 1 and 15 parts by weight ethoxylated castor oil with a composition containing about 7% ethoxylated castor oil showing the greatest improvement in storage stability but with a minimal (about a 21% increase in HST size) sizing improvement over the control ASA emulsion.

Therefore, a need remains in the art for sizing compositions having improved emulsion quality, e.g., with median particle sizes of less than about 5 $\mu$m and preferably less than about 3 $\mu$m, sizing performance and operability, particularly with respect to conventional sizing emulsions such as those containing ASA or AKD. The present invention provides such improved sizing emulsions. Moreover, since typical sizing agents such as ASA and AKD tend to have very low solubility in water, there remains a problem in that the sizing efficiency of the sizing agent is less than is desired because the sizing agent is not uniformly distributed throughout the paper in a manner that gives maximum sizing. Additionally, because a large percentage of a conventional sizing agent is not always retained by the paper, operability problems and economic disadvantages arise when the nonretained conventional sizing agent goes instead into the white water. Surprisingly, the instant inventors have discovered that the sizing efficiency of a sizing agent is increased when it is contained in a sizing composition that also contains a hydrophobic substance that is not a sizing agent. The teachings of all patents and other literature articles referenced herein are incorporated herein by reference.

SUMMARY OF THE INVENTION

One embodiment of the present invention relates to a paper sizing composition comprised of at least one sizing agent selected from ASA, AKD and rosin where the sizing agent is emulsified in water, at least one emulsion stabilizer, and from about 0.01% to about 15% by weight of at least one hydrophobic substance, based on the total weight of sizing agent present, where the hydrophobic substance is not highly alkoxylated. The sizing promotion efficiency of this paper sizing composition as determined by at least one method selected from the Cytec size testing method, the Hercules size testing method, and the Cobb size testing method is greater than or equal to about 4. Preferably, the quantity of hydrophobic substance present is from about 0.1% to about 10% by weight based on the total weight of sizing agent present. Preferably, the sizing promotion efficiency of the paper sizing composition is greater than or equal to about 6 and, more preferably, greater than or equal to about 10.

The hydrophobic substance may be selected from the group consisting of fatty acid esters, triglycerides, hydrocarbons, esters derived from ASA, amides derived from ASA, silicone oils, alcohols, and mixtures thereof and the sizing agent may be at least one synthetic sizing agent. Preferably, the sizing agent is selected from ASA, AKD, and mixtures thereof. More preferably, each sizing agent, independently, has an alkyl or alkenyl group comprising from about 8 to about 36 carbon atoms. Alternately, the sizing agent is at least one succinic anhydride substituted, independently, by a substantially linear alkyl or alkenyl group comprising from about 16 to about 18 carbon atoms. The quantity of sizing agent present is from about 3% to about 38% by weight based on the total weight of emulsion present.

A suitable emulsion stabilizer may be selected from cationic synthetic polymers, cationic starches, and mixtures thereof. The quantity of emulsion stabilizer present in the paper sizing composition may be from about 9% to about 400% by weight based on the total weight of sizing agent present. Preferably, the emulsion has a median emulsion particle size of about 5 $\mu$m or less and, more preferably, about 3 $\mu$m or less.

Another embodiment of the present invention relates to a paper sizing composition comprised of at least one sizing agent selected from ASA, AKD and rosin where the sizing agent is emulsified in water, at least one emulsion stabilizer, and from about 0.01% to about 15% by weight of at least one hydrophobic substance, based on the total weight of sizing agent present, where the sizing promotion efficiency of the paper sizing composition as determined by at least one method selected from the Cytec size testing method, the Hercules size testing method, and the Cobb size testing method is greater than or equal to about 4. The hydrophobic substance is selected from the group consisting of fatty acid esters comprising aliphatic fatty acid portions containing from about 7 to about 41 carbon atoms, which are optionally monounsaturated or diunsaturated and, whether unsaturated or not, are optionally substituted with at least one hydroxy group, triglycerides comprising aliphatic fatty acid portions containing from about 4 to about 22 carbon atoms, which are optionally monounsaturated or diunsaturated and, whether unsaturated or not, are optionally substituted with at least one hydroxy group, substantially straight chain hydrocarbons containing from about 6 to about 34 carbon atoms, which are optionally terminally unsaturated and, if unsaturated, are optionally isomerized, ASA derivatives formed from the reaction products of about 1 mole of ASA with about 1 mole of 1-octadecanol or 1-hexadecylamine, about 0.2 moles cholesterol or about 1 mole cholesterol, and the reaction products of about 9.25 or of about 3 moles ASA with about 1 mole castor oil, the silicone oils poly (dimethylsiloxane) optionally comprising side chains selected from PEO, PPO, and mixtures thereof, poly (diphenylsiloxane), poly(methylphenylsiloxane), poly(t-butyl-methylsiloxane), poly(dimethylsiloxane-co-alkylmethylsiloxane) where the alkyl comprises, independently, from about 1 to about 18 carbon atoms, poly[dimethylsiloxane-co-3-(aminopropylmethylsiloxane)], hydride- terminated poly(dimethylsiloxane), and distearate-terminated poly(dimethylsiloxane), aloe-emodin, aloin, cholesterol, lanosterol, and mixtures thereof, provided that the hydrophobic substance is not highly alkoxylated.

A further embodiment of the invention relates to a paper sizing composition comprised of at least one sizing agent selected from ASA, AKD and rosin where the sizing agent is emulsified in water, at least one emulsion stabilizer, and from about 0.01% to about 15% by weight of lanolin, based on the total weight of sizing agent present, with the proviso that the lanolin is not highly alkoxylated, where the sizing promotion efficiency of the paper sizing composition as determined by at least one method selected from the Cytec size testing method, the Hercules size testing method, and the Cobb size testing method is greater than or equal to about 10. The sizing agent in this composition is selected from ASA, AKD, and mixtures thereof where each sizing agent, independently, has an alkyl or alkenyl group comprising from about 8 to about 36 carbon atoms. Preferably, the sizing agent is at least one succinic anhydride substituted, independently, by a substantially linear alkyl or alkenyl group comprising from about 16 to about 18 carbon atoms. Each emulsion stabilizer present may be suitably selected from cationic synthetic polymers, cationic starches, and mixtures thereof. The quantity of all emulsion stabilizers present may be from about 9% to about 400% by weight based on the total weight of sizing agent(s) present.

An additional embodiment of the invention relates to a method for sizing paper products, the method comprising forming a paper sizing composition, such as any of those described above, dispersing the composition throughout a paper stock, and optionally forming a web from the paper stock on a paper making machine to form a sized paper product. The method may also include passing the sized paper product through a drying stage.

An alternate embodiment of the present invention relates to paper or paperboard treated with any sizing composition described above.

DETAILED DESCRIPTION OF THE INVENTION

One embodiment of the present invention relates to compositions for sizing paper. The sizing compositions of this invention comprise at least one hydrophobic substance which is not a sizing agent, at least one sizing agent selected from ASA, AKD and rosin where the sizing agent is emulsified in water, and at least one emulsion stabilizer.

The sizing composition of this invention comprises at least one hydrophobic substance. As used herein, the term "hydrophobic substance" refers to a material which is not highly alkoxylated and which is substantially hydrophobic, i.e., one that is substantially water insoluble, but which is substantially soluble in n-hexane, cyclohexane and/or toluene. Accordingly, a hydrophobic substance is soluble, at most, up to about 5% by weight in water at about 25° C. but is soluble in n-hexane and/or cyclohexane and/or toluene in amounts greater than about 4% by weight over the temperature range of about 25 to 65° C., as appropriate. As used herein, the term "alkoxylated" refers to a compound which is derivatized by reacting the compound with an alkylene oxide, e.g., ethylene oxide or propylene oxide. As used herein, the term "highly alkoxylated" refers to a compound which is reacted with an alkylene oxide, e.g., the lowest molecular weight alkylene oxide, ethylene oxide, such that the alkoxylated compound comprises at least about 5 moles of ethylene oxide per mole of the compound. Any hydrophobic substance comprising carbon-carbon unsaturation may, optionally, be at least partially hydrogenated to substantially fully hydrogenated by any method known to those of ordinary skill in the art. Therefore, the term "hydrophobic substance" as used herein also refers to a hydrophobic substance which is at least partially hydrogenated. The sizing agents ASA, AKD and rosin are not contemplated as the hydrophobic substance within this invention. Exemplary hydrophobic substances include but are not limited to:

fatty acid esters, triglycerides, hydrocarbons, esters and/or amides derived from ASA, silicone oils, alcohols, and stearic anhydride.

Each of these categories of hydrophobic substance is commercially available and discussed in more detail below.

The fatty acid esters are a useful category of hydrophobic substances of the invention. They include fatty acid esters which are obtained from synthetic and naturally occurring sources, such as animals and plants. Exemplary fatty acid esters include but are not limited to lanolin, beeswax, jojoba bean oil and camauba wax.

Lanolin, a fat-like liquid or waxy secretion of the sebaceous glands of sheep which is deposited onto wool, is well known in the art. It is considered to be a complex mixture of naturally occurring esters comprised of about 33 water insoluble alcohols, mainly of the aliphatic, steroid and triterpenoid types, and about 36 higher fatty acids, mainly of the saturated nonhydroxylated, hydroxylated, and unsaturated nonhydroxylated types. See Merck Index, 12$^{th}$ Ed., 1996, p. 916. More particularly and as shown in Table A, the acid component of lanolin mainly comprises normal, iso, anteiso, α-hydroxy normal, α-hydroxy iso, α-hydroxy anteiso, and ω-hydroxy normal acids of various chain lengths ranging from about 7 to about 41 carbon atoms.

TABLE A

Acid Components of Lanolin

| Acid | Carbon Chain Length | % of All Lanolin Acids |
|---|---|---|
| Normal acids | $C_8$—$C_{38}$ | 10 |
| Iso acids | $C_8$—$C_{40}$ | 22 |
| Anteiso acids | $C_7$—$C_{41}$ | 28 |
| Normal α-hydroxy acids | $C_{10}$—$C_{32}$ | 17 |
| Iso α-hydroxy acids | $C_{12}$—$C_{34}$ | 9 |
| Anteiso α-hydroxy acids | $C_{11}$—$C_{33}$ | 3 |
| Normal ω-hydroxy acids | $C_{22}$—$C_{36}$ | 3 |
| Iso ω-hydroxy acids | $C_{22}$—$C_{36}$ | 0.5 |
| Anteiso ω-hydroxy acids | $C_{22}$—$C_{35}$ | 1 |
| Polyhydroxy acids | | 4.5 |
| Unsaturated acids | | 2 |
| Total | | 100% |

Nearly all of the acids in lanolin are saturated. The alcohol component is a complex mixture of aliphatic and cyclic compounds and mainly comprises cholesterol, lanosterol, dihydrolanosterol, and highly branched alkane alcohols, as shown in Table B.

TABLE B

Alcohol Components of Lanolin

| Alcohol | Carbon Chain Length | % of All Lanolin Alcohols |
|---|---|---|
| Normal mono-alcohols | $C_{14}$—$C_{34}$ | 2 |
| Iso mono-alcohols | $C_{14}$—$C_{36}$ | {13 (1:1) |
| Anteiso mono-alcohols | $C_{17}$—$C_{35}$ | 1 |
| Normal alkane 1,2-diols | $C_{12}$—$C_{25}$ | { 6 (1:05) |
| Iso alkane 1,2 diols | $C_{14}$—$C_{30}$ | 34 |
| Anteiso alkane 1,2 diols | $C_{15}$—$C_{29}$ | {38 |
| Cholesterol | | 6 |
| Lanosterol | | |
| Dihydrolanosterol | | |
| Hydrocarbons, autoxidation products and undetermined | | |
| Total | | 100% |

The components of lanolin are defined in further detail in the art, for example, by K. J. Motiuk, J. Am. Oil Chemists Soc., 1979, vol. 56, pp. 91–97 and 651–658 and K. J. Motiuk, J. Am. Oil Chemists Soc., 1980, vol. 57, pp. 145. Therefore and as used herein, the term "lanolin" refers to a material which comprises at least one fatty acid ester formed from at least one of the fatty acid components of lanolin comprising at least about 7 carbon atoms as disclosed in Table A above and at least one of the alcohol components of lanolin disclosed in Table B above.

Beeswax, a white (when bleached) to yellowish (when not bleached) soft to brittle wax obtained from the honeycomb of the bee, is well known to comprise a complex mixture of a majority fatty acid ester component mixed with about 10–20% by weight of straight chain hydrocarbons of from about 23 to about 35 carbon atoms and about 10–15% by weight of free fatty acids, some of which may comprise at least one hydroxy group. It is well known that the fatty acid ester component comprises straight-chain monohydric alcohols having from about 20 to about 36 carbon atoms, esterified with straight-chain acids having an even number carbon atoms from about 16 to about 36. See Ullmann's Encyclopedia of Industrial Chemistry,5$^{th}$ Ed., 1996, Vol. A28, "Waxes", pp. 119–120. Exemplary ester components of beeswax include triacontanol hexadecanoate and hexacosanol hexacosanoate. See Merck Index, 12$^{th}$ Ed., 1996, pp. 170–171.

Jojoba bean oil orjojoba oil, a liquid wax ester mixture obtained from the nuts of the jojoba bush, is well known to contain esters formed from straight chain monounsaturated acids and alcohols, each component of these esters comprising from about 16 to about 24 carbon atoms. It is well known that the majority acid components of the liquid wax esters comprise eicosenoic (about 67%), docosenoic (about 14.5%), and octadecenoic (about 12.5%) acids while the majority alcohol components comprise eicosenol (about 48%) and docosenol (about 41%). See Ullmann's Encyclopedia of Industrial Chemistry, 5$^{th}$ Ed., 1996, Vol. A28, "Waxes", p. 117.

Carnauba wax is a hard, high melting, crystalline vegetable wax obtained from the leaves or leaf buds of the camauba palm. It is well known to comprise about 40% by weight aliphatic esters formed from fatty acids with an average chain length of about 26 carbon atoms and monohydric alcohols with an average chain length of about 32 carbon atoms, about 13% by weight of esters of ωhydroxycarboxcylic acids with about 26 or about 28 carbon atoms and monohydric alcohols with about 30 or about 32 carbon atoms, and about 12% by weight of free alcohols with an average chain length of about 32 carbon atoms. Camauba wax also comprises, in oligomeric and polymeric form, about 21% by weight of diesters of 4-hydroxycinnamic acid and about 7% by weight of diesters of 4-methoxycinnamic acid. See Ullmann's Encyclopedia of Industrial Chemistry, $5^{th}$ Ed., 1996, Vol. A28, "Waxes", p. 112.

Preferred fatty acid ester hydrophobic substances include but are not limited to those esters comprising aliphatic fatty acid portions containing from about 7 to about 41 carbon atoms, which are optionally unsaturated and, whether unsaturated or not, are optionally substituted with at least one hydroxy group. If at least a portion of the preferred fatty acid ester hydrophobic substance comprises carbon-carbon unsaturation, preferably the fatty acid portions of such esters are monounsaturated, diunsaturated, or mixtures thereof. More preferred fatty acid ester hydrophobic substances include but are not limited to lanolin, beeswax, jojoba bean oil, carnauba wax, and mixtures thereof.

The triglycerides are another useful category of hydrophobic substances of the invention. The triglyceride hydrophobic substances of the invention include, for example, castor oil and cocoa butter.

Castor oil, a pale yellow viscous oil, is well known to comprise triglycerides of the fatty acid ricinoleic acid, present as the majority component, with oleic, linoleic, palmitic, stearic and dihydroxystearic acids also present, i.e., saturated, monounsaturated and diunsaturated fatty acids containing from about 16 to about 18 carbon atoms and optionally substituted with at least one hydroxy group. See Merck Index, $12^{th}$ Ed., 1996, pp. 311–312.

Cocoa butter, the edible fat which is commonly obtained by mechanically pressing cocoa beans, cocoa nibs, etc., is well known to comprise triglycerides of stearic, palmitic and oleic fatty acids, i.e., saturated and monounsaturated fatty acids of from about 16 to about 18 carbon atoms. It is well known that the following species are present in cocoa butter: oleo-palmitostearin, oleo-distearin, palmito-diolein, stearo-diolein, oleo-dipalmitin, tri-olein, and some tri-saturated species of unspecified fatty acids. See B. L. Zoumas and J. F. Smullen, "Chocolate and Cocoa" in Kirk-Othmer Encyclopedia of Chemical Technology, $4^{th}$ Ed., 1993, Vol. 6, p. 185.

Preferred triglyceride hydrophobic substances include but are not limited to those triglycerides comprising aliphatic fatty acid portions containing from about 4 to about 22 carbon atoms, which are optionally unsaturated and, whether unsaturated or not, are optionally substituted with at least one hydroxy group. If at least a portion of the preferred triglyceride hydrophobic substance comprises carbon-carbon unsaturation, preferably the fatty acid portions of such triglycerides are monounsaturated, diunsaturated, or mixtures thereof. More preferred triglyceride hydrophobic substances include but are not limited to those triglycerides comprising aliphatic fatty acid portions containing from about 16 to about 18 carbon atoms, which are optionally unsaturated and, whether unsaturated or not, are optionally substituted with at least one hydroxy group. If at least a portion of the preferred triglyceride hydrophobic substance comprises carbon-carbon unsaturation, preferably the fatty acid portions of such triglycerides are monounsaturated, diunsaturated, or mixtures thereof. Most preferably, the triglyceride hydrophobic substances include but are not limited to castor oil, cocoa butter, and mixtures thereof.

The hydrocarbons are yet another useful category of hydrophobic substances of the invention. These substances include alkanes, for example, the higher substantially straight chain hydrocarbons containing from about 6 to about 34 carbon atoms, such as n-hexane and candelilla wax. Candelilla wax, a hard brittle wax obtained from the euphorbia and pedilanthus plants, is well known to comprise, as its main constituent, hentriacontane, i.e., a straight chain hydrocarbon of about 31 carbon atoms. See Merck Index, $12^{th}$ Ed., 1996, p. 283. The hydrocarbons also include, for example, the higher alicyclic hydrocarbons containing from about 6 to about 50 carbon atoms, such as cyclohexane, and hydrocarbon mixtures, such as petroleum naphtha (i.e., petroleum ether). The hydrocarbon hydrophobic substance may optionally comprise carbon-carbon double bonds, e.g., alicyclic hydrocarbons, such as cyclohexene, and the alpha olefins of higher substantially straight chain hydrocarbons such as 1-tetradecene, 1-hexadecene, 1-octadecene and 1-docosene. Such unsaturated hydrocarbons, e.g., the alpha olefins, may optionally be isomerized, i.e., reacted with a catalyst to statistically redistribute the unsaturation throughout the molecule.

Preferred hydrocarbon hydrophobic substances include but are not limited to substantially straight chain hydrocarbons containing from about 6 to about 34 carbon atoms, which are optionally terminally unsaturated and, if unsaturated, are optionally isomerized, and alicyclic hydrocarbons containing from about 6 to about 50 carbon atoms. More preferred hydrocarbon hydrophobic substances include but are not limited to substantially straight chain hydrocarbons containing from about 14 to about 32 carbon atoms, which are optionally terminally unsaturated. Most preferably, hydrocarbon hydrophobic substances include but are not limited to candelilla wax, the olefins, preferably $\alpha$-olefins, containing from about 14 through about 22 carbon atoms, and mixtures thereof.

Another category of useful hydrophobic substances is the ester and/or amide derivatives of ASA. These materials include, for example, the alcohol, amine, castor oil, lanolin alcohol and cholesterol derivatives of ASA. For example, the product of the reaction of about 1 mole of ASA and about 1 mole of a higher substantially aliphatic alcohol or amine, such as 1-octadecanol and 1-hexadecylamine, respectively, provides a useful hydrophobic substance. Additionally, the product of the reaction of about 1 mole of ASA and from about 1 to about 0.2 moles of cholesterol or lanolin alcohol, e.g., lanosterol or dihydrolanosterol, provides a useful hydrophobic substance. Also, the product of the reaction of from about 9.25 to about 3 moles of ASA and about 1 mole of castor oil provides a useful hydrophobic substance.

These ester and/or amide derivatives of ASA may be formed in an anhydride ring opening reaction by reacting ASA with an alcohol, an amine or a mixture thereof. For example, a 1-octadecanol derivative of ASA may be prepared as follows. A three-neck, 100 mL round bottomed flask equipped with a nitrogen inlet and an outlet to a bubbler, a thermocouple, and an overhead stirrer may be charged with 50.0 g ASA (0.148 moles) and 40.2 g 1-octadecanol (0.148 moles). The mixture may be heated to about 65° C. with stirring, under nitrogen and maintained at 65–70° C. for about 2 hours. The reaction may be analyzed for opening of the ASA anhydride ring through infrared spectroscopy by monitoring the diminution of the intensity of the bands at about 1864 $cm^{-1}$ and about 1779 $cm^{-1}$, corresponding to the carbonyls of the ASA anhydride ring, and the appearance of a band at about 1714 $cm^{-1}$, which indicates the presence of the desired ring-opened reaction product.

Preferred ASA derivative hydrophobic substances include but are not limited to the reaction products of about 1 mole of ASA with about 1 mole of 1-octadecanol or 1-hexadecylamine, with about 0.2 moles of cholesterol or with about 1 mole of cholesterol, the reaction products of about 9.25 or of about 3 moles ASA with about 1 mole of castor oil, and mixtures thereof. More preferred ASA derivative hydrophobic substances include but are not limited to the reaction product of about 1 mole of ASA with about 1 mole of 1-hexadecylamine.

The silicone oils are a further useful category of hydrophobic substances. The silicone oil hydrophobic substances of the invention are oligomers, polymers, copolymers or mixtures thereof each comprising at least one recurring unit represented by the formula—$Si(R)_2O$—, where each R is independently selected from alkyl, such as methyl, ethyl, propyl, and t-butyl, fluorinated alkyl, vinyl, phenyl, alkoxy and alkylamino, each of which may, optionally be substituted by hydroxy, such as hydroxymethyl, or by carboxyl, such as carboxypropyl, i.e., —$CH_2$—$CH_2$—$CH_2$—COOH. Optionally, the silicone oil may be end-capped with other moieties, such as hydride or stearate. Optionally, the silicone oil may further comprise polymeric side chains such as polyoxyethylene or polyethylene oxide (hereafter "PEO") or polyoxypropylene or polypropylene oxide (hereafter "PPO"). Preferably, the aforesaid recurring unit(s) comprise the majority of each silicone oligomer, polymer and copolymer.

Exemplary silicone oils include but are not limited to poly(dimethylsiloxane), poly(diphenylsiloxane), poly (methylphenylsiloxane), poly(t-butyl-methylsiloxane), poly (dimethylsiloxane-co-alkylmethylsiloxane) where the alkyl comprises, independently, from about 1 to about 18 carbon atoms, poly[dimethylsiloxane-co-3-(aminopropylmethylsiloxane)], hydrogen-terminated polysiloxanes such as hydride-terminated poly(dimethylsiloxane), stearate-terminated polysiloxanes such as distearate-terminated poly (dimethylsiloxane) and silicone oils such as poly (dimethylsiloxane) further comprising side chains selected from PEO, PPO, and mixtures thereof. Preferred silicone oil hydrophobic substances include but are not limited to poly (methylphenylsiloxane), poly(dimethylsiloxane-co-alkylmethylsiloxane) where the alkyl comprises, independently, from about 1 to about 18 carbon atoms, poly[dimethylsiloxane-co-3-(aminopropylmethylsiloxane)], and poly(dimethylsiloxane) further comprising side chains selected from PEO, PPO, and mixtures thereof An additional category of useful hydrophobic substances is the alcohols comprising at least about 12 carbon atoms and one or a plurality of hydroxy groups. Polyfunctional alcohols are those comprising a plurality of hydroxy groups. For example, alcohols include but are not limited to aloe based compounds, such as aloe-emodin and aloin, cholesterol, and lanosterol. Aloe-emodin, also known as 1,8-dihydroxy-3-(hydroxymethyl)-9,10-anthracenedione or rhabarberone, is a well known component of various species of aloe and comprises three hydroxy groups. See Merck Index, $12^{th}$ Ed., 1996, p. 55. Aloin, also known as 10-glucopyranosyl-1,8-dihydroxy-3-(hydroxymethyl)-9 (10H)-anthracenone or barbaloin, is a well known isolate from various species of aloe and comprises seven hydroxy groups. See Merck Index, $12^{th}$ Ed., 1996, pp. 55–56. Cholesterol, also known as (3β)-cholest-5-en-ol or cholesterin, is a well known sterol of the higher animals and comprises a hydroxy group. See Merck Index, $_{12}$th Ed., 1996, p. 369. Lanosterol, also known as (3β)-lanosta-8,24-dien-3-ol or kryptosterol, is well known as the core steroid from which all others are derived and comprises a hydroxy group. See Merck Index, $12^{th}$ Ed., 1996, pp. 916.

Stearic anhydride may be added to ASA-based compositions and emulsions described herein to enhance the sizing efficacy of the resultant compositions and emulsions. For example, by dispersing from about 0.3% to about 8% by weight stearic anhydride into an ASA sizing emulsion, preferably from about 0.3% to about 3% by weight, a size enhancement of paper sized therewith by as much as from about 15% to about 30% is obtained over otherwise identically sized paper but where no stearic anhydride is used. However, stearic anhydride is known to be only sparingly soluble in ASA at room temperature, i.e., its solubility is about 0.2% by weight. Therefore and without limitation to any particular theory, upon cooling a hot stearic anhydride solution with ASA or an emulsion with stearic anhydride dissolved in the ASA phase, the stearic anhydride is thought to precipitate and to cause undesirable solidification of the ASA. The following improved methods, all of which eliminate this undesirable effect, have been found to be effective for preparing ASA compositions comprising greater amounts of stearic anhydride than could heretofore be incorporated.

Solutions of stearic anhydride may be dissolved in warm ASA at various levels, e.g., from about 0.5 to about 4% by weight, and homogenized for about 10 to about 25 minutes, either at low speed in a laboratory blender or at high speed in a Ross mixer. The solutions may be cooled without further mixing to form cloudy liquids. Without limitation to any particular theory, the stearic anhydride is thought to be dispersed and/or dissolved in the ASA in such cloudy liquids. In general, the higher the concentration of stearic anhydride the cloudier the cooled solution. However, all of such solutions remain liquid after cooling to room temperature. Alternatively, the warm solutions, without homogenization, may be stirred with a magnetic stirring bar as the solutions cool to form cloudy liquids which remain liquid after cooling to room temperature. Therefore, either hot homogenization, stirring during cooling, or their equivalent should provide sufficient agitation to inhibit the undesirable solidification of the ASA/stearic anhydride mixtures. Thus, any of these methods allow for more stearic anhydride to be dispersed in the ASA which, in turn, yields enhanced sizing performance in paper or board sized with such compositions.

Additionally, mixtures of hydrophobic substances selected from the same and/or from different categories described above can be used.

Preferred hydrophobic substances include but are not limited to fatty acid esters, triglycerides, hydrocarbons, ester derivatives of ASA, amide derivatives of ASA, silicone oils, alcohols, and mixtures thereof. More preferred hydrophobic substances include but are not limited to fatty acid esters comprising aliphatic fatty acid portions containing from about 7 to about 41 carbon atoms, which are optionally monounsaturated or diunsaturated and, whether unsaturated or not, are optionally substituted with at least one hydroxy group; triglycerides comprising aliphatic fatty acid portions containing from about 4 to about 22 carbon atoms, which are optionally monounsaturated or diunsaturated and, whether unsaturated or not, are optionally substituted with at least one hydroxy group; substantially straight chain hydrocarbons containing from about 6 to about 34 carbon atoms, which are optionally terminally unsaturated and, if unsaturated, are optionally isomerized; ASA derivatives formed from the reaction products of about 1 mole ASA with about 1 mole 1-octadecanol or 1-hexadecylamine, about 0.2 moles cholesterol and about 1 mole cholesterol, and the reaction products of about 9.25 and of about 3 moles ASA with about 1 mole castor oil; the silicone oils poly (dimethylsiloxane) optionally comprising side chains selected from PEO, PPO, and mixtures thereof, poly (diphenylsiloxane), poly(methylphenylsiloxane), poly(t-butyl-methylsiloxane), poly(dimethylsiloxane-co-alkylmethylsiloxane) where the alkyl comprises, independently, from about 1 to about 18 carbon atoms, poly[dimethylsiloxane-co-3-(aminopropylmethylsiloxane)], hydride-terminated poly(dimethylsiloxane), and distearate-terminated poly(dimethylsiloxane); aloe-emodin, aloin, cholesterol, lanosterol; and mixtures thereof. Most preferably, the hydrophobic substance is selected from lanolin, castor oil and cocoa butter.

The quantity of hydrophobic substance present in a sizing composition of the invention may be from about 0.01% to about 15% by weight based on the total weight of sizing agent present. Preferably, the quantity of hydrophobic substance present in a sizing composition is from about 0.1% to about 10% by weight. The quantity of hydrocarbon hydrophobic substance required in the sizing compositions of the invention may be greater when compared with the quantity of any of the other classes of hydrophobic substances discussed in detail above.

The addition of at least one hydrophobic substance to a sizing composition and/or to a sizing emulsion provides a substantially improved sizing and sized paper over a substantially identical size not comprising the hydrophobic substance(s). This improvement can be quantified by a term known as the sizing promotion efficiency. As used herein, the term "sizing promotion efficiency" refers to the ratio of the percent improvement in sizing to the weight percent of hydrophobic substance present, based on the total weight of sizing agent present. That is, "sizing promotion efficiency" is defined by the following equation:

$$\text{Sizing promotion efficiency} = \frac{\%\ \text{sizing improvement}}{(\text{weight of hydrophobic substance} \times 100)/\text{weight of sizing agent}}$$

The sizing promotion efficiency of the paper sizing compositions of the invention and the papers sized therewith is greater than or equal to about 4. The sizing promotion efficiency of the paper sizing compositions of the invention and the papers sized therewith is, preferably, greater than or equal to about 6 and, more preferably, greater than or equal to about 10.

The % sizing improvement can be obtained by any known size performance measuring method. Such methods include but are not limited to the Cytec size testing method (hereafter "CST"), the Hercules size testing method (hereafter "HST"), and the Cobb size testing method (hereafter "Cobb test"). Each of these test procedures is well known to those of ordinary skill in the art and is discussed in more detail below. Briefly, the CST and HST tests measure the time needed for a standard ink to penetrate through a paper sample under standardized conditions by monitoring the reflectance on the opposite side of the sample to detect the appearance of the ink while the Cobb test determines the quantity of water absorbed per square meter in a specified time under standardized conditions. Moreover, as one of ordinary skill in the art would readily recognize, certain sizing efficiency tests are favored for particular types of paper substrates. For example, the CST or the HST methods are favored when sizing efficacy for bleached or unbleached paper or board is being evaluated while the Cobb test is favored when a non-bibulous, i.e., nonabsorbent, stock is being evaluated, e.g., non-bibulous paper, non-bibulous board or non-bibulous corrugated fiberboard. The preferred method for evaluating the sizing promotion efficiency of the paper sizing compositions of the invention and the papers sized therewith is at least one method selected from the group consisting of the Cytec size testing method, the Hercules size testing method, and the Cobb size testing method.

The sizing compositions of this invention also comprise at least one sizing agent selected from the group consisting of ASA, AKD, and rosin. As used herein, the term "rosin" refers to the residue remaining after the oil is distilled off from the oleoresin obtained from various species of pines. Rosin is known to those in the art to comprise abietic acid and/or abietic anhydride. Rosin-based materials or derivatives such as rosin soap, which may be prepared, e.g., by reacting rosin with sodium hydroxide, and fortified rosin may also be useful sizing agents. Therefore, the term "rosin" as used herein also refers to any rosin-based material or derivative.

As used herein, the term "ASA" refers to a cyclic dicarboxylic acid anhydride, which has the chemical structure of formula 1:

(1)

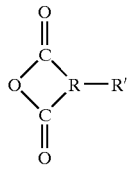

where R' is a hydrophobic group containing more than about 4 carbon atoms and selected from alkyl, alkenyl, aralkyl or aralkenyl groups and R is a dimethylene or trimethylene radical, i.e., substituted succinic anhydride and substituted glutaric anhydride, respectively.

As used herein, the term "alkyl" refers to a straight or branched hydrocarbon chain. As used herein, the phrase straight chain or branched chain hydrocarbon chain means any substituted or unsubstituted acyclic carbon-containing compounds, including alkanes, alkenes and alkynes. Examples of alkyl groups include lower alkyl, for example, methyl, ethyl, n-propyl, iso-propyl, n-butyl, iso-butyl, tert-butyl or iso-hexyl; upper alkyl, for example, n-heptyl, n-octyl, iso-octyl, nonyl, decyl, and the like; lower alkylene, for example, ethylene, propylene, propylyne, butylene, butadiene, pentene, n-hexene or iso-hexene; and upper alkylene, for example, n-heptene, n-octene, iso-octene, nonene, decene and the like. The ordinary skilled artisan is familiar with numerous straight, i.e., linear, and branched alkyl groups, which are within the scope of the present invention. In addition, such alkyl groups may also contain various substituents in which one or more hydrogen atoms is replaced by a functional group.

As used herein, the term "alkenyl" refers to a straight or branched hydrocarbon chain where at least one of the carbon-carbon linkages is a carbon-carbon double bond. As used herein, the term "aralkyl" refers to an alkyl group which is terminally substituted with at least one aryl group. As used herein, the term "aralkenyl" refers to an alkenyl group which is terminally substituted with at least one aryl group. As used herein, the term "aryl" refers to a hydrocarbon ring bearing a system of conjugated double bonds, often comprising at least six n (pi) electrons. Examples of aryl groups include, but are not limited to, phenyl, naphthyl, anisyl, toluyl, xylenyl and the like.

ASA sizing agents are described in, for example, the '064 patent, and in U.S. Pat. Nos. Re. 29,960, 3,821,069, 3,968,005, 4,040,900 and 4,687,519.

The ASA sizing agent may be a substituted succinic anhydride of the following formula:

(2)

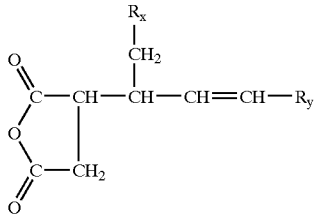

where $R_x$ and $R_y$ are, independently, linear or branched alkyl groups containing at least 4 carbon atoms. Alternatively, the ASA sizing agent may be a substituted succinic anhydride of the following formula:

(3)

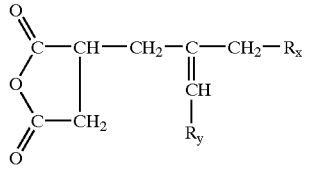

where $R_x$ and $R_y$ are as defined above.

Specific examples of sizing agents useful in the instant invention include but are not limited to iso-octadecenyl succinic anhydride, n-hexadecenyl succinic anhydride, dodecenyl succinic anhydride, decenyl succinic anhydride, dodecyl succinic anhydride, octenyl succinic anhydride, triisobutenyl succinic anhydride, 1-octyl-2-decenyl succinic anhydride, 1-hexyl-2-decenyl succinic anhydride, and mixtures thereof.

Preferred ASA sizing agents include but are not limited to those substituted by a hydrophobic group comprising more than about four carbon atoms and, preferably, substituted by a hydrophobic group comprising from about 8 to about 36 carbon atoms. More preferred ASA sizing agents include but are not limited to succinic anhydrides substituted by a hydrophobic group comprising more than about four carbon atoms and, preferably, substituted by a hydrophobic group comprising from about 8 to about 36 carbon atoms. Even more preferred ASA sizing agents include but are not limited to succinic anhydrides substituted by a hydrophobic group comprising from about 8 to about 36 carbon atoms and, preferably, substituted by an alkyl or alkenyl group comprising from about 8 to about 24 carbon atoms. Most preferred ASA sizing agents include but are not limited to succinic anhydrides substituted by a substantially linear alkyl or alkenyl group comprising from about 16 to about 18 carbon atoms, such as octadecenyl succinic anhydride. Most preferred sizing agents include ACCOSIZE® 17 ASA and ACCOSIZE® 18 ASA, the latter further comprising a surfactant, both commercially available from Cytec Industries, Inc.

As used herein, the term "AKD" refers to alkyl and alkenyl ketene formed into dimers with a chemical structure accepted by those of ordinary skill in the art as illustrated by formula 4:

(4)

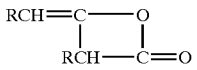

where each R is, independently, a hydrophobic group containing more than about 4 carbon atoms and selected from alkyl, alkenyl, aralkyl or aralkenyl groups, as defined above. Preferably, each R is, independently, a hydrophobic group containing from about 4 carbon atoms to about 36 carbon atoms. AKD sizing agents are described in detail in several references, for example, U.S. Pat. Nos. 3,992,345 and 5,510,003; in J. W. Davis et al., TAPPI 39(1), 21 (1956); and in R. E. Cates et al., "Alkyl Ketene Dimer Sizes", Chapter 2 in *The Sizing of Paper*, 2nd Edition, W. F. Reynolds, Ed., Tappi Press, 1989, pp. 33–50.

Specific examples of AKD sizing agents useful in the instant invention include but are not limited to octyl ketene dimer, decyl ketene dimer, dodecyl ketene dimer, tetradecyl ketene dimer, hexadecyl ketene dimer, octadecyl ketene dimer, eicosyl ketene dimer, docosyl ketene dimer, tetracosyl ketene dimer, and those prepared by known methods from organic acids and naturally occurring mixtures of fatty acids such as those found in palmitoleic acid, oleic acid, rincinoleic acid, linoleic acid, linolenic acid, coconut oil, palm oil, olive oil and peanut oil. Mixtures of any of such acids may also be used. Preferred AKD sizing agents include but are not limited to those comprising at least one alkyl or alkenyl group comprising from about 8 to about 36 carbon atoms. More preferred AKD sizing agents include but are not limited to hexadecyl, octadecyl and oleyl ketene dimer.

Preferably, the sizing agent is at least one sizing agent selected from ASA, AKD, and rosin. More preferably, the sizing agent is at least one synthetic sizing agent, such as ASA comprising alkyl and/or alkenyl groups and AKD comprising alkyl and/or alkenyl groups. Preferred synthetic sizing agents include but are not limited to ASA, AKD, and mixtures thereof where each, independently, has at least one alkyl or alkenyl group comprising from about 8 to about 36 carbon atoms. Even more preferably, the synthetic sizing agent is at least one substituted succinic anhydride where each R' group, independently, is an alkyl or alkenyl group comprising from about 8 to about 36 carbon atoms.

The sizing emulsions of this invention also suitably may contain at least one surfactant to facilitate their emulsification in water; such materials are well known in this art. As used herein, the term "sizing agent is emulsified in water" refers to a stable mixture of two or more immiscible liquids present in the form of a continuous phase and a disperse phase held in place by a small amount of surfactant where the continuous phase comprises water and the disperse phase comprises at least one sizing agent present in the form of liquid particles or droplets. Surfactants such as the cationic, anionic, and nonionic surfactants may be used. Surfactants are described in, for example, the '946 patent at column 2, line 57 through column 3, line 55, in U.S. Pat. No. 4,040,900 to Mazzarella et al. (hereafter "the '900 patent"), particularly at column 4, line 54 through column 5, line 46, and in U.S. Pat. No. 5,759,249 to Wasser, particularly at column 4, lines 17–57.

Suitable surfactants include but are not limited to phosphated ethoxylates which may contain alkyl, aryl, aralkyl or alkenyl hydrocarbon substituents, sulfonated products such as those obtained from sulfonating fatty alcohols or aromatic fatty alcohols, ethoxylated alkyl phenols such as nonyl phenoxy polyethoxy ethanols and octyl phenoxy polyethoxy ethanols, polyethylene glycols such as PEG 400 monooleate and PEG 600 dilaurate, ethoxylated phosphate esters, dialkyl sulfosuccinates such as sodium dioctyl sulfosuccinate, polyoxyalkylene alkyl or polyoxyalkylene alkylaryl ethers or corresponding mono- or di-esters, and trialkyl amines and their acid and quatemary salts as well as amine hydrates such as oleyl dimethylamine and stearyl dimethylamine.

Preferred surfactants are those which emulsify the sizing agent and hydrophobic substance to give the smallest median emulsion droplet diameter or particle size. Such emulsions may have a median emulsion droplet diameter or particle size of about 5 pm or less, preferably about 4 $\mu$m or less, and most preferably about 3 $\mu$m or less. Droplet size may be conveniently measured by any number of well-known particle size measurement techniques, e.g., microscopy, classical and quasi-elastic light scattering, sedimentation, disc centrifugation, electrozone sensing, sedimentation field flow fractionation and chromatographic methods. Conveniently, droplet sizes may be estimated by a light scattering method using an instrument such as a Horiba LA-700 particle size analyzer or, preferably, by a centrifugation method using an instrument such as a Horiba CAPA 700 particle size analyzer.

The quantity of surfactant present in a sizing composition of the invention is not critical and may, of course, vary depending upon the particular surfactant or surfactant blend used, as is well known to those of ordinary skill in this art. However, it is preferable that, when the sizing composition is emulsified, the surfactant concentration is adjusted such that the resulting emulsion has a median particle size of, most preferably, about 3 $\mu$m or less. From about 0.01% to about 10% of surfactant by weight based on the total weight of sizing agent present may be used. Preferably, the quantity of surfactant present in a sizing composition is from about 0.1% to about 5% by weight. Commercially available mixtures comprising at least one sizing agent and at least one surfactant, such as ACCOSIZE® 18 ASA available from Cytec Industries, Inc., may be conveniently used in forming the sizing emulsions of the invention.

The sizing compositions of this invention also suitably may contain an effective amount of at least one emulsion stabilizer sufficient to reduce phase separation, such as starch or a synthetic polymer. Such emulsion stabilizers are well known in this art and exemplary types are described in, e.g., the '946 patent. Any agent that reduces phase separation may be used as an emulsion stabilizer. Exemplary emulsion stabilizers include but are not limited to synthetic and naturally occurring cationic, anionic, amphoteric and nonionic polymers.

In particular, synthetic cationic polymers may be used as emulsion stabilizers. The many synthetic polymers known to be useful in papermaking may be used, such as cationic polyacrylamides, e.g., copolymers of acrylamide with cationic monomers such as the salts and quaternaries of dialkylaminoalkyl (alk)acrylate, dialkylaminoalkyl (alk) acrylamide, polymers and copolymers of diallyldialkylammonium halides, e.g., polydiallyldimethylammonium chloride, polyamines, e.g., polyhydroxyalkylamines, vinylamine/vinyl alcohol copolymers, polyethyleneimines, polyamidoamines, and cationic condensation polymers, e.g., amine-epichlorohydrin polymers. For example, cationic water soluble vinyl addition polymers, such as those disclosed in the '946 patent, and cationic polyacrylamides, such as those disclosed in JP05173287, may be used.

Additionally, naturally occurring cationic polymers such as guar gum, native starches, including amylose and non-amylose containing starches, and the like may be used as emulsion stabilizers. Typical starches include but are not limited to corn starch, tapioca starch, wheat starch, rice starch, waxy maize starch, and yellow dent corn starch. For example, cationic starch derivatives, such as those disclosed in the '064 patent, may be used. Cationic guar gum is also known to be an effective emulsion stabilizer.

Natural and synthetic anionic polymers, e.g., anionic polyacrylamides, carboxymethylcellulose and phosphorylated starches, natural and synthetic amphoteric polymers, e.g., cationic potato starch, and natural and synthetic nonionic polymers, e.g., polyacrylamides which are not hydrolyzed, may also be used as emulsion stabilizers.

Preferred emulsion stabilizers include but are not limited to starch, the synthetic polymers known to be useful in papermaking, and mixtures thereof. More preferably, the emulsion stabilizer is a cationic synthetic polymer, a cationic starch, and mixtures thereof.

Emulsion stabilizers may be added in amounts sufficient to prevent phase separation. A suitable quantity of the emulsion stabilizer(s) present in a sizing composition of the invention is from about 9% to about 400% by weight based on the total weight of sizing agent present. When the emulsion stabilizer is or comprises starch, it is suitably present at a concentration of from about 10% to about 400% by weight based on the total weight of sizing agent present. Preferably, the starch is present at a concentration of from about 25% to about 200% by weight based on the total weight of sizing agent present. When the emulsion stabilizer is a synthetic stabilizer, it is suitably present at a concentration of from about 9% to about 100% by weight based on the total weight of sizing agent present. Preferably, the synthetic stabilizer is present at a concentration of from about 10% to about 50% by weight based on the total weight of sizing agent present.

The sizing compositions of the invention may be formed into sizing emulsions using any emulsification procedure and system known in the art. Commercially, those skilled in the art recognize that the equipment used to prepare sizing emulsions may be either low shear or high shear. Historically, it was difficult to prepare stable, uniform sizing emulsions at low shear, so high shear techniques were used which tended to require relatively complex, expensive and heavy equipment capable of exerting high homogenizing shear and/or pressures, together with rigid procedures regarding, e.g., emulsifying proportions and temperatures, for producing a satisfactory stable emulsion of a desirable median particle size. The distinction between high shear and low shear conditions is well-known in the art, as evidenced by the disclosures of the '671 and '900 patents and also in U.S. Pat. Nos. 4,687,519 and 4,544,414; Canadian Patent No. 1,069,410; C. E. Farley and R. B. Wasser, "Sizing with Alkenyl Succinic Anhydride," Chapter 3 in *The Sizing of Paper*, 2$^{nd}$ Edition, W. F. Reynolds, Ed., Tappi Press, 1989, p. 54–55; G. Chen and T. Woodward, "Optimizing the Emulsification and Sizing of Alkenyl Succinic Anhydride," Tappi Journal, August 1986, pp. 95–97; and J. C. Roberts, "Neutral and Alkaline Sizing," in *Paper Chemistry*, Blackie & Son, 1991, p. 125, all of which are hereby incorporated herein by reference.

Compositions and processes which allow sizing emulsions to be prepared at low shear, i.e., without the necessity of high shear turbine pumps, but merely by stirring, passing through a mixing valve, or by the usual agitation, present in a paper stock preparation system, may advantageously increase the operational flexibility of the papermaking process with concomitant increases in production efficiency. Useful commercial emulsification equipment includes industrial low and high pressure units, such as Cytec low pressure turbine emulsifiers supplied by Cytec Industries, Inc., Nalco high pressure emulsifier systems, and National Starch turbine and venturi emulsifiers. Preferably, the emulsion has an aqueous continuous phase, i.e., an oil-in-water emulsion.

A suitable quantity of the sizing agent(s) in an initial sizing emulsion of the present invention is from about 0. 1% to about 50% based on the total weight of all the components of the emulsion. Preferably, the sizing agent is present at a concentration of from about 3% to about 38% and, more preferably, at a concentration of from about 4% to about 17% by weight of all the sizing agents present in an initial sizing emulsion based on the total weight of all the components of the emulsion.

Emulsions comprising ASA may be prepared using a ratio of cationic starch to ASA of about 3:1 by weight. Both materials are fed in-line to a high shear turbine pump. The cationic starch is cooked and cooled prior to being fed into the turbine pump. The starch is used to provide mechanical stability and enhance sizing efficiency. Synthetic polymers can be used in place of the starch as a "starch substitute," in which case the starch-substitute to ASA ratio may be about 0.4:1 by weight. The particulars of forming emulsions comprising ASA are well known to the art and are described in, e.g., C. E. Farley and R. B. Wasser, "Sizing with Alkenyl Succinic Anhydride," Chapter 3 in *The Sizing of Paper*, $2^{nd}$ Edition, W. F. Reynolds, Ed., Tappi Press, 1989, p. 54–55.

Emulsions comprising AKD may be prepared by blending, for about one minute, about 10 parts by weight of molten AKD with about 100 parts by weight of about 3% aqueous, 180° F. cooked, cationic starch that contains about 0.15 parts by weight of sodium lignosulfate. The initial sizing emulsion thus formed is then cooled by further dilution to about 1% solids by weight in water to form a paper sizing emulsion. The particulars of forming emulsions comprising AKD are well known to the art and are described in, e.g., U.S. Pat. No. 4,859,244.

The present invention also relates to methods for using these paper sizing compositions and emulsions in the production of paper products and paper products manufactured using either the methods or compositions described herein. The compositions and emulsions of the invention may be used to size paper and paperboard products well known to the art, including but not limited to linerboard, corrugating medium, fluting medium, box board, OCC linerboard, gypsum wall board, construction board, saturating paper and board, neutral fine paper, alkaline fine paper, acid fine paper, and non-woven paper.

While the paper sizing compositions and emulsions of the invention may be used to size paper products by any known method, a preferred embodiment of the present invention relates to the addition of the sizing emulsion before the paper web has been formed. An initial sizing emulsion of the present invention can simply be added to the wet end of a paper making machine or to a stock preparation system, with or without further dilution, to provide a concentration of the sizing agent of from about 0.01% to about 2% and, preferably, from about 0.1% to about 0.5% by weight based on dry fiber weight of the paper or board. Within these ranges, the precise amount of the sizing emulsion used will depend upon the type of pulp being treated, the specific operating conditions, and the particular end use of the paper product. For example, paper in which good water resistance or ink holdout is desired will require a higher concentration of size than paper used in applications where those properties are not as critical. The invention may also be practiced by spraying the instant paper sizing compositions onto a paper web or by direct application of the instant paper sizing compositions at the size press.

The methods of sizing of the present invention are not limited to paper of any particular pH range, and are applicable to the treatment of any of neutral, alkaline, and acidic pulp. Therefore, the sizing compositions and emulsions may be used in combination with alum and promoters, including polyaluminum chloride and polyaluminum sulfate silicate which are very commonly used in making paper, as well as other acid materials. The sizing compositions and emulsions may also be used with calcium carbonate or other alkaline materials in the paper stock. The preferred pH of paper pulp can vary depending upon the size used. For example, a hydrophobic substance/ASA/surfactant sizing composition in accordance with this invention may be used at a pH range of from about 4 to about 9, preferably from about 6 to about 8.

The sizing compositions and emulsions of the present invention may be successfully used for the sizing of paper and paperboard prepared from all types of both cellulosic and combinations of cellulosic and non-cellulosic fibers. Also included are sheet-like masses and molded products prepared from combinations of cellulosic and non-cellulosic materials derived from synthetics, such as polyamide, polyester and polyacrylic resin fibers, as well as from mineral fibers, such as asbestos and glass. The hardwood or softwood cellulosic fibers which may be used include, but are not limited to, bleached and unbleached sulfate (Kraft), bleached and unbleached sulfite, bleached and unbleached soda, neutral sulfite, semi-chemical, groundwood, chemi-groundwood, and any combination of such fibers. In addition, synthetic cellulosic fibers, such as viscose rayon or regenerated cellulose, can also be used, as well as recycled waste papers from various sources.

Any pigment or filler known in the art may be added in the usual manner to the paper product sized with the invention. Such materials include clay, talc, titanium dioxide, calcium carbonate, such as precipitated or ground grades, calcium sulfate and diatomaceous earths. Stock additives, e.g., defoamers, pitch dispersants, and slimicides, as well as other sizing compounds, can also be used with the sizing compositions and emulsions described herein.

Additionally, the present invention relates to paper products prepared using the sizing compositions and emulsions and methods described herein.

The paper and board that is produced according to the present invention may contain auxiliary materials known in the art as useful for incorporation into paper or board by adding them to the pulp at the wet end, directly to the paper or board or to a liquid medium, e.g., starch solution, which is then used to impregnate paper sheets or board. Representative examples of auxiliary agents include defoamers, bactericides, pigments, fillers, crosslinking agents and the like.

The following procedures illustrate methods of sample preparation and testing useful in further defining certain embodiments of the present invention.

Procedure 1: HST Method

The performance of sized paper relative to aqueous inks is commonly very sensitive to the dosage of sizing agent and to sheet composition, therefore, careful control and measurement of the sizing effectiveness is required. Performance was quantified by evaluating sized handsheets by a method similar to the TAPPI T 530 test method, the so-called Hercules size testing method or HST as is well known in this art, by the following procedure.

The HST method is a general purpose test for the degree of paper sizing and measures the resistance of paper to permeation of a mildly acidic, colored, aqueous penetrant. This test uses a device which measures the time needed for the penetrant or ink to penetrate through a paper sample by monitoring the reflectance of the opposite side of the sample to detect the appearance of the colored ink. Although a variety of aqueous liquids containing a dye can be used as the ink, the anionic green dye naphthol green B (Ricoamide Napthol Green B Dye obtained from Rite Industries), with about 1% formic acid, was used in all of the HST testing. Acid ink containing about 1% formic acid was prepared by dissolving about 12.5 g of naphthol green dye in about 500 mL distilled water, adding about 25.0 g of 40% formic acid and then adding distilled water to a total volume of 1000 mL.

Paper samples were evaluated by the HST test after a conditioning period of at least one day at 72° F. and 50% relative humidity after the handsheets were prepared until maximum sizing efficiency was reached. HST testing was conducted according the procedures set-out in the TAPPI T 530 pm-89 test method to 80% of the initial reflectance of each specimen except that three handsheet specimens were tested, with two repetitions on each felt side and two on each wire side, for a total of six tests on each side. The elapsed time of the test, as indicated by a timer, was recorded to the nearest second. The average test time for the three specimens on the felt side and the average test time for the three specimens on the wire side were calculated. Unless otherwise indicated, the results from the felt side and the wire side did not differ significantly, therefore, an average for the tests on both sides was calculated and reported.

The "% sizing improvement" as used herein in reference to the HST test refers to the percentage difference in the size value, $S_1$, measured by HST testing for any paper or board comprising a sizing composition of the invention, i.e., comprising at least one hydrophobic substance, in relation to the size value, $S_0$, measured by HST testing for the same paper or board comprising a substantially identical size but from which the hydrophobic substance(s) is substantially absent. That is, "% sizing improvement" in reference to the HST test is defined by the following equation:

$$\%\ \text{sizing improvement} = \frac{(S_1 - S_0) \times 100}{S_0}$$

Procedure 2: CST Method

The Cytec size testing method, or CST, providing a fully automated application of ink to the under surface of the paper together with automatic measurement of the optical end point, was also utilized to provide an easy to use, consistent method for quantifying sizing effectiveness by ink penetration testing. This method uses the same principle as the TAPPI T 530 test but uses an advanced penetrometer which provides an automated design and different geometry for light sources and detector. In particular, all steps of the CST test were performed automatically with this apparatus: on the push of a start button, ink was pumped into a well until the ink contacted the under surface of the paper, determined electronically, and the timing of the ink penetration was obtained from a reflectance measurement and was displayed digitally, automatically recorded, and transferred electronically to a personal computer. The fully automated ink penetrometer used is described in detail in U.S. Pat. No. 5,483,078 to Hermann et al.

Neutral ink buffered to pH 7.0 was used in all CST testing and was prepared by dissolving 12.5+0.05 g of naphthol green B dye in about 500 mL of a pH 7 buffer solution (PC 1024B-7 obtained from BNL Fine Chemicals and Reagents). Further buffer solution was then added to bring the total volume to 1000 mL at 23° C.

Paper samples were evaluated by the CST test after a conditioning period of at least one day at 72° F. and 50% relative humidity after the handsheets were prepared until maximum sizing efficiency was reached. Three handsheet specimens were tested, with two repetitions on each felt side and two on each wire side, for a total of six tests on each side.

To begin a CST test, each paper specimen was inserted into the apparatus. A fiber optic source cable provided uniform illumination of the top side of the specimen. A detector fiber optic cable viewed the same area of illumination. The initial reflectance of the specimen was determined automatically and stored for reference.

The test ink was automatically metered by a metering pump from a reservoir into the bottom of a cone-shaped ink well until the ink contacted the underside of the paper specimen under test, at which time a timer was started electronically. The change in reflectance was periodically monitored automatically and the timer was stopped when a pre-specified percentage decrease in reflectance was reached. This decrease was about 20%, i.e., the specimen retained about 80% of its initial reflectance. The elapsed time of the test was displayed and recorded to the nearest second. Then a drain pump was started automatically and run for a period of time long enough to empty the ink in the well into a waste reservoir.

The average test time for the three specimens on the felt side and the average test time for the three specimens on the wire side were calculated. Unless otherwise indicated, the results from the felt side and the wire side did not differ significantly, therefore, an average for the tests on both sides was calculated and reported.

The "% sizing improvement" as used herein in reference to the CST test refers to the percentage difference in the size value, $S_1$, measured by CST testing for any paper or board comprising a sizing composition of the invention, i.e., comprising at least one hydrophobic substance, in relation to the size value, $S_0$, measured by CST testing for the same paper or board comprising a substantially identical size but from which the hydrophobic substance(s) is substantially absent. That is, "% sizing improvement" in reference to the CST test is defined by the following equation:

$$\%\ \text{sizing improvement} = \frac{(S_1 - S_0) \times 100}{S_0}$$

Procedure 3: Cobb Size Testing Method

Sizing performance was also quantified by evaluating the water absorptiveness of non-bibulous sized paper, paperboard, and corrugated fiberboard sheets by a method similar to the TAPPI T 441 test method, the so-called Cobb size testing method or Cobb test as is well known in this art, by the following procedure.

The Cobb test determines the quantity of water absorbed per square meter, i.e., the Cobb value, by non-bibulous paper, paperboard, and corrugated fiberboard in a specified time under standardized conditions. A testing apparatus with a test area of about 100 $cm^2$ and a pressure head for the water being absorbed of about 1 cm was used. The apparatus permitted one side of each specimen to be wetted uniformly at the moment the water soaking period began and allowed controlled rapid removal of the water from each specimen at the end of the test period. The apparatus comprised a 2.5 cm high metal ring with about an 11.28 cm inside diameter (corresponding to a cross-sectional area of about 100 $cm^2$), a flat base plate larger than the outer diameter of the ring, a rubber mat larger than the outside diameter of the ring and on which the specimen was clamped, and a crossbar clamping mechanism by which the metal ring was secured to the base plate with wing nuts.

Each test specimen, of a size slightly greater than the outside diameter of the test apparatus ring, e.g., squares about 12.5 cm on each side, was first weighed. Then, the weighed specimen was placed on the dry rubber mat on the metal plate, the dry metal ring was placed on the specimen, and the assembly was fastened firmly with the crossbar wing nuts to prevent any leakage between the ring and the specimen. Thus, the test side, either wire or felt, was the one in contact with water during the test. A stopwatch was started as about 100 mL of distilled water was rapidly poured into the ring. After about 110 seconds, the water was quickly poured from the ring. The specimen was unclamped and placed with its wetted side up on a sheet of blotting paper. At the end of the 120 second test period, a second sheet of blotting paper was placed on top of the specimen and surplus water was removed by moving a metal hand roller, having a smooth face about 20 cm wide and weighing about 10 kg, once back and once forward over the blotting paper. The tested specimen was then immediately reweighed.

Paper samples were evaluated by the Cobb test after a conditioning period of at least one day at 72° F. and 50% relative humidity after the handsheets were prepared until maximum sizing efficiency was reached. Cobb testing was conducted according the procedures set-out in the TAPPI T 441 om-98 test method, as summarized above. The weight gain after the test was recorded to the nearest 0.01 g. The average weight gain for three specimens on the felt side and the average weight gain for three specimens on the wire side were calculated. Unless otherwise indicated, the results from the felt side and the wire side did not differ significantly, therefore, an average for the tests on both sides was calculated and reported as the Cobb value by multiplying the average weight gain by 100 to obtain the weight of water absorbed in grams per square meter.

The "% sizing improvement" as used herein in reference to the Cobb test refers to the percentage difference in the size value, $S_1$, measured by Cobb testing for any paper or board comprising a sizing composition of the invention, i.e., comprising at least one hydrophobic substance, in relation to the size value, $S_0$, measured by Cobb testing for the same paper or board comprising a substantially identical size but from which the hydrophobic substance(s) is substantially absent. That is, "% sizing improvement" in reference to the Cobb test is defined by the following equation:

$$\%\ \text{sizing improvement} = \frac{(S_0 - S_1) \times 100}{S_0}$$

Procedure 4: Preparation of Handsheets Sized at 2 lb/ton

A paper sizing emulsion with a mixture of starch/size of about 4/1 by weight was prepared from an initial sizing emulsion as follows. About 25 g of initial sizing emulsion was diluted with about 71.3 g of about 4% cationic cold-water soluble starch-solids-in-water solution and then further diluted to a total volume of about 385 mL with deionized water to provide an about 0.25 weight % ASA paper sizing emulsion, based on the total weight of the emulsion, at a ratio of starch/size of about 4/1 by weight.

Standard 50/50 bleached kraft hardwood/softwood blend, refined to approximately 500 CSF freeness, was diluted with water to a consistency of about 0.6% by weight and treated with about 80 ppm by weight sodium sulfate and about 50 ppm by weight calcium chloride. ALBACAR® 5970 calcium carbonate filler, at about 15% by weight concentration in the furnish, was also added. The stock was then adjusted to about pH 7.8. The same salt additions and pH adjustments were done on the dilution water in the overhead tank. Handsheets were prepared using a standard (8"×8") Noble and Wood handsheet mold to a target basis weight of 50 lbs/TAPPI ream. The typical chemical addition sequence per 10 gram fiber batch was as follows: about 4 mL of paper sizing emulsion (about 1 minute mixing), ACCURAC® 171 anionic polyacrylamide retention aid at about 1 lb/ton (about 15 second mixing). Each batch was then split into three 2.8 dry gram sheets. The sheets were formed, pressed between felts in the nip of a pneumatic roll press at about 15 psi, and drum dried on a rotary drier for about 1 minute at about 240° F.

Procedure 5: Preparation of Handsheets Sized at 2.5 lb/ton

Handsheets were prepared following the procedure described in Procedure 4, except that the handsheets were sized at a level of about 2.5 pounds of size emulsion per ton of pulp by adding about 5 mL of paper sizing emulsion per 10 gram fiber batch.

EXAMPLES

As noted above, the sizing compositions and emulsions, methods of using the sizing compositions and emulsions, and paper products produced using these sizing compositions and emulsions and methods yield paper products with superior sizing properties. The following examples further illustrate certain embodiments of the present invention. These examples are provided solely for illustrative purposes and in no way limit the scope of the present invention.

Example 1

Sizing With Lanolin/ASA Emulsions

About 2 kg of an ASA/surfactant mixture (ACCOSIZE® 18 ASA from Cytec Industries, Inc., hereafter "ASA-1"), was placed in a 3 liter, 3-neck round-bottom flask with either about 91 g or about 182 g of lanolin to prepare a concentrated solution under nitrogen. The lanolin was obtained from Aldrich. The resulting mixture was stirred and heated to 75–80° C. to dissolve the lanolin. The heat source was removed when the lanolin was completely dissolved, the concentrated solution was allowed to cool to room temperature, and the concentrated solution was added to the remainder of the ASA solution to give a final lanolin solution of either about 0.5 or 1.0 weight %, respectively, in ASA.

Initial emulsions with a mixture of starch/size about 1/1 by weight were prepared from the above sizing compositions by the following procedure. About 190 g of an about 4% cationic cold-water soluble starch-solids-in-water solution was added to a laboratory blender. In separate preparations, the aqueous starch solution was emulsified on low speed and about 7.6 g of each lanolin in ASA solution, and a control which contained no lanolin, was added to the vortex. The contents of the blender were emulsified on high speed for about 60 seconds. This provided an about 3.85% by weight ASA initial sizing emulsion at a ratio of starch/size of about 1/1 by weight.

The resulting emulsions were used to form paper sizing emulsions which were, in turn, used to size handsheets as described in Procedure 4. The handsheets were tested by CST as described in Procedure 2. The data from the CST testing is shown compared to a size applied at the same level but containing no lanolin in Table 1.

TABLE 1

CST Sizing Data (Neutral green ink to 80% reflectance)

| Amount Lanolin in ASA | Size (sec) | Δ Size (%) | Sizing Promotion Efficiency |
|---|---|---|---|
| 0% | 461 | 0 | — |
| 0.5% | 560 | 21 | 42 |
| 1.0% | 418 | −9 | −9 |

Example 2

Sizing With 0.5% Lanolin/ASA Emulsion at 2.5 lb/ton

An ASA initial sizing emulsion containing about 0.5% lanolin by weight based on the weight of ASA was prepared following the procedure described in Example 1. This emulsion was used to size handsheets as described in Procedure 5, i.e., at about 2.5 lb/ton. The handsheets were tested by CST as described in Procedure 2. The data from the CST testing is shown compared to a size applied at the same level but containing no lanolin in Table 2.

TABLE 2

CST Sizing Data (Neutral green ink to 80% reflectance)

| Amount Lanolin in ASA | Size (sec) | Δ Size (%) | Sizing Promotion Efficiency |
|---|---|---|---|
| 0% | 684 | 0 | — |
| 0.5% | 934 | 36.5 | 73 |

Example 3

Sizing With 0.5% Beeswax/ASA Emulsion

An ASA initial sizing emulsion containing about 0.5% beeswax by weight based on the weight of ASA was prepared following the procedure described in Example 1 except that beeswax, obtained from Aldrich, was used in place of the lanolin. This emulsion was used to size handsheets as described in Procedure 4. The handsheets were tested by CST as described in Procedure 2. The data from the CST testing is shown compared to a size applied at the same level but containing no beeswax in Table 3.

TABLE 3

CST Sizing Data (Neutral green ink to 80% reflectance)

| Amount Beeswax in ASA | Size (sec) | Δ Size (%) | Sizing Promotion Efficiency |
|---|---|---|---|
| 0% | 206 | 0 | — |
| 0.5% | 273 | 32.5 | 65 |

Example 4

Sizing With 0.5% Jojoba Bean Oil/ASA Emulsion

An ASA initial sizing emulsion containing about 0.5% jojoba bean oil by weight based on the weight of ASA was prepared following the procedure described in Example 1 except that jojoba bean oil, obtained from Aldrich, was used in place of the lanolin. This emulsion was used to size handsheets as described in Procedure 4. The handsheets were tested by CST as described in Procedure 2. The data from the CST testing is shown compared to a size applied at the same level but containing no jojoba bean oil in Table 4.

TABLE 4

CST Sizing Data (Neutral green ink to 80% reflectance)

| Amount Jojoba Bean Oil in ASA | Size (sec) | Δ Size (%) | Sizing Promotion Efficiency |
|---|---|---|---|
| 0% | 224 | 0 | — |
| 0.5% | 289 | 29 | 58 |

Example 5

Sizing With 0.5% Carnauba Wax/ASA Emulsion

An ASA initial sizing emulsion containing about 0.5% carnauba wax by weight based on the weight of ASA was prepared following the procedure described in Example 1 except that carnauba wax, obtained from Aldrich, was used in place of the lanolin. This emulsion was used to size handsheets as described in Procedure 4. The handsheets were tested by CST as described in Procedure 2. The data from the CST testing is shown compared to a size applied at the same level but containing no carnauba wax in Table 5.

TABLE 5

CST Sizing Data (Neutral green ink to 80% reflectance)

| Amount Carnauba Wax in ASA | Size (sec) | Δ Size (%) | Sizing Promotion Efficiency |
|---|---|---|---|
| 0% | 206 | 0 | — |
| 0.5% | 278 | 35 | 70 |

Example 6

Sizing With Castor Oil/ASA Emulsions

Two ASA initial sizing emulsions, containing about 0.5% and 1.0% castor oil by weight based on the weight of ASA, were prepared by following the procedure described in Example 1 except that castor oil, obtained from Aldrich, was used in place of the lanolin. The emulsions were used to size handsheets as described in Procedure 4. The handsheets were tested by CST as described in Procedure 2. The data from the CST testing is shown compared to a size applied at the same level but containing no castor oil in Table 6.

TABLE 6

CST Sizing Data (Neutral green ink to 80% reflectance)

| Amount Castor Oil in ASA | Size (sec) | Δ Size (%) | Sizing Promotion Efficiency |
|---|---|---|---|
| 0% | 235 | 0 | — |
| 0.5% | 253 | 8 | 16 |
| 1.0% | 614 | 161 | 61 |

Example 7

Sizing With Castor Oil/ASA Emulsions at 2.5 lb/ton

Two ASA initial sizing emulsions, containing about 0.5% and 1.0% castor oil by weight based on the weight of ASA, were prepared by following the procedure described in Example 6. The emulsions were used to size handsheets as described in Procedure 5, i.e., at about 2.5 lb/ton. The handsheets were tested by CST as described in Procedure 2. The data from the CST testing of handsheets sized at about 2.5 lb/ton is shown compared to a size applied at the same level but containing no castor oil in Table 7.

TABLE 7

CST Sizing Data (Neutral green ink to 80% reflectance)

| Amount Castor Oil in ASA | Size (sec) | Δ Size (%) | Sizing Promotion Efficiency |
|---|---|---|---|
| 0% | 684 | 0 | — |
| 0.5% | 538 | −21 | −42 |
| 1.0% | 1039 | 52 | 52 |

Comparative Example 8

Sizing With Ethoxylated Castor Oil/ASA Emulsions

Two ASA initial sizing emulsions, containing about 0.5% and 1.0% ethoxylated castor oil by weight based on the weight of ASA, were prepared by following the procedure described in Example 1 except that an ethoxylated castor oil, the product of a reaction between about 35 moles of ethylene oxide and about 1 mole of castor oil and obtained from Aldrich, was used in place of the lanolin. An additional ASA emulsion was formed from a final ethoxylated castor oil solution of about 3.0 weight %, by weight of ASA, by the procedure described in Example 1 except that the quantity of the above-described ethoxylated castor oil used was about 546 g. These emulsions were used to size handsheets as described in Procedure 4. The handsheets were tested by CST as described in Procedure 2. The data from the CST testing is shown compared to a size applied at the same level but containing no ethoxylated castor oil in Tables 8 and 9.

TABLE 8

CST Sizing Data (Neutral green ink to 80% reflectance)

| Amount Ethoxylated Castor Oil in ASA | Size (sec) | Δ Size (%) | Sizing Promotion Efficiency |
|---|---|---|---|
| 0% | 332 | 0 | — |
| 0.5% | 277 | −17 | −33 |
| 1.0% | 265 | −20 | −20 |

TABLE 9

CST Sizing Data (Neutral green ink to 80% reflectance)

| Amount Ethoxylated Castor Oil in ASA | Size (sec) | Δ Size (%) | Sizing Promotion Efficiency |
|---|---|---|---|
| 0% | 488 | 0 | — |
| 3.0% | 167 | −66 | −22 |

Example 9

Sizing With Hexanes/ASA Emulsions

An ASA initial sizing emulsion containing about 0.5% hexanes by weight based on the weight of ASA was prepared following the procedure described in Example 1 except that hexanes, obtained from Aldrich and described to comprise at least about 85% of n-hexane with the balance other hexane isomers and methylcyclopentane, were used in place of the lanolin. Another ASA emulsion was formed from a final hexanes solution of about 5.0 weight % by weight of ASA by the procedure described in Example 1 except that about 910 g of hexanes were used in place of lanolin. These emulsions were used to size handsheets as described in Procedure 4. The handsheets were tested by CST as described in Procedure 2. The data from the CST testing is shown compared to a size applied at the same level but containing no hexanes in Table 10.

TABLE 10

CST Sizing Data (Neutral green ink to 80% reflectance)

| Amount Hexanes in ASA | Size (sec) | Δ Size (%) | Sizing Promotion Efficiency |
|---|---|---|---|
| 0% | 208 | 0 | — |
| 0.5% | 239 | 15 | 30 |
| 5.0% | 255 | 22.5 | 4.5 |

Example 10

Sizing With 0.5% Candelilla Wax/ASA Emulsion

An ASA initial sizing emulsion containing about 0.5% candelilla wax by weight based on the weight of ASA was prepared following the procedure described in Example 1 except that candelilla wax, obtained from Aldrich, was used in place of the lanolin. This emulsion was used to size handsheets as described in Procedure 4. The handsheets were tested by CST as described in Procedure 2. The data from the CST testing is shown compared to a size applied at the same level but containing no candelilla wax in Table 11.

TABLE 11

CST Sizing Data (Neutral green ink to 80% reflectance)

| Amount Candelilla Wax in ASA | Size (sec) | Δ Size (%) | Sizing Promotion Efficiency |
|---|---|---|---|
| 0% | 224 | 0 | — |
| 0.5% | 355 | 58 | 116 |

Example 11

Sizing With Alpha-Olefin/ASA Emulsions

Two ASA initial sizing emulsions, containing about 0.5% and 5.0% alpha-olefin by weight based on the weight of ASA, were prepared following the procedure described in Example 9 except that an alpha-olefin of 16 to 18 carbon atoms, obtained from Amoco, was used in place of the hexanes. This emulsion was used to size handsheets as described in Procedure 4. The handsheets were tested by CST as described in Procedure 2. The data from the CST testing is shown compared to a size applied at the same level but containing no alpha-olefin in Table 12.

TABLE 12

CST Sizing Data (Neutral green ink to 80% reflectance)

| Amount Alpha-Olefin in ASA | Size (sec) | Δ Size (%) | Sizing Promotion Efficiency |
|---|---|---|---|
| 0% | 208 | 0 | — |
| 0.5% | 233 | 12 | 24 |
| 5.0% | 285 | 37 | 7.4 |

Example 12

Sizing With 0.5% (3 ASA/1 Castor Oil) Derivative/ASA Emulsion

An ASA initial sizing emulsion containing about 0.5% of the above derivative by weight based on the weight of ASA was prepared following the procedure described in Example 1 except that a derivative formed by the reaction of about 3 moles of ASA-1 with about 1 mole of castor oil, obtained from Aldrich, was used in place of the lanolin. This emulsion was used to size handsheets as described in Procedure 4. The handsheets were tested by CST as described in Procedure 2. The data from the CST testing is shown compared to a size applied at the same level but containing no derivative in Table 13.

TABLE 13

CST Sizing Data (Neutral green ink to 80% reflectance)

| Amount (3 ASA/1 Castor Oil) Derivative in ASA | Size (sec) | Δ Size (%) | Sizing Promotion Efficiency |
|---|---|---|---|
| 0% | 224 | 0 | — |
| 0.5% | 247 | 10 | 20 |

Example 13

Sizing With 0.5% (9.25 ASA/1 Castor Oil) Derivative/ASA Emulsion

An ASA initial sizing emulsion containing about 0.5% of the above derivative by weight based on the weight of ASA was prepared following the procedure described in Example 12 except that a derivative formed by the reaction of about 9.25 moles of ASA-1 with about 1 mole of castor oil, obtained from Aldrich, was used. This emulsion was used to size handsheets as described in Procedure 4. The handsheets were tested by CST as described in Procedure 2. The data from the CST testing is shown compared to a size applied at the same level but containing no derivative in Table 14.

TABLE 14

CST Sizing Data (Neutral green ink to 80% reflectance)

| Amount (9.25 ASA/1 Castor Oil) Derivative in ASA | Size (sec) | Δ Size (%) | Sizing Promotion Efficiency |
|---|---|---|---|
| 0% | 437 | 0 | — |
| 0.5% | 535 | 22 | 44 |

Example 14

Sizing With 0.5% (1 ASA/0.2 Cholesterol) Derivative/ASA Emulsion

An ASA initial sizing emulsion containing about 0.5% of the above derivative by weight based on the weight of ASA was prepared following the procedure described in Example 1 except that a derivative formed by the reaction of about 1 mole of ASA-1 with about 0.2 moles of cholesterol, obtained from Aldrich, was used in lace of the lanolin. This emulsion was used to size handsheets as described in Procedure 4. The handsheets were tested by CST as described in Procedure 2. The data from the CST testing is shown compared to a size applied at the same level but containing no derivative in Table 15.

TABLE 15

CST Sizing Data (Neutral green ink to 80% reflectance)

| Amount (1 ASA/0.2 Cholesterol) Derivative in ASA | Size (sec) | Δ Size (%) | Sizing Promotion Efficiency |
|---|---|---|---|
| 0% | 206 | 0 | — |
| 0.5% | 286 | 39 | 78 |

Example 15

Sizing With 0.5% (1 ASA/1 Hexadecylamine) Derivative/ASA Emulsion

An ASA initial sizing emulsion containing about 0.5% of the above derivative by weight based on the weight of ASA was prepared following the procedure described in Example 1 except that a derivative formed by the reaction of about 1 mole of ASA-1 with about 1 mole of hexadecylamine, obtained from Aldrich, was used in place of the lanolin. This emulsion was used to size handsheets as described in Procedure 4. The handsheets were tested by CST as described in Procedure 2. The data from the CST testing is shown compared to a size applied at the same level but containing no derivative in Table 16.

TABLE 16

CST Sizing Data (Neutral green ink to 80% reflectance)

| Amount (1 ASA/1 Hexadecylamine) Derivative in ASA | Size (sec) | Δ Size (%) | Sizing Promotion Efficiency |
|---|---|---|---|
| 0% | 279 | 0 | — |
| 0.5% | 415 | 49 | 97 |

Example 16

Sizing with 0.5% Silicone Oil/ASA Emulsion

An ASA initial sizing emulsion containing about 0.5% silicone oil by weight based on the weight of ASA was prepared following the procedure described in Example 1 except that high temperature silicone oil, obtained from Aldrich and described to comprise poly (methylphenylsiloxane), was used in place of the lanolin. This emulsion was used to size handsheets as described in Procedure 4. The handsheets were tested by CST as described in Procedure 2. The data from the CST testing is shown compared to a size applied at the same level but containing no silicone oil in Table 17.

TABLE 17

CST Sizing Data (Neutral green ink to 80% reflectance)

| Amount Silicone Oil in ASA | Size (sec) | Δ Size (%) | Sizing Promotion Efficiency |
|---|---|---|---|
| 0% | 224 | 0 | — |
| 0.5% | 238 | 6 | 12 |

Example 17

Sizing With 0.5% Polysiloxane with Polymeric Side Chains/ASA Emulsion

An ASA initial sizing emulsion containing about 0.5% of polysiloxane by weight based on the weight of ASA was prepared following the procedure described in Example 1 except that RITASIL® 193 silicone compound, obtained from the Rita Corporation and described to comprise a polymer of dimethylsiloxane with PEO and PPO side chains (CAS No. 64365–23–7), was used in place of the lanolin. This emulsion was used to size handsheets as described in Procedure 4. The handsheets were tested by CST as described in Procedure 2. The data from the CST testing is shown compared to a size applied at the same level but containing no silicone compound in Table 18.

TABLE 18

CST Sizing Data (Neutral green ink to 80% reflectance)

| Amount RITASIL ® 193 Polysiloxane in ASA | Size (sec) | Δ Size (%) | Sizing Promotion Efficiency |
|---|---|---|---|
| 0% | 208 | 0 | — |
| 0.5% | 260 | 25 | 50 |

Example 18

Sizing With Lanolin/AKD Emulsions

AKD initial sizing emulsions were prepared following the procedure described in Example 1 except that AQUAPEL® 364 alkyl ketene dimer (CAS No. 68390–56–7), obtained from Hercules Inc. and described to be an alkyl ketene dimer derived from long-chain fatty acids, was substituted for ASA and the starch stock solution was used warm, e.g., from about 30 to about 50° C. AKD emulsions containing about 0.5% and 3% lanolin by weight based on the weight of AKD were also prepared following the procedure described in Example 1, incorporating the modifications described above. The emulsions were used to size handsheets as described in Procedure 4. The handsheets were tested by CST as described in Procedure 2. The data from the CST testing is shown compared to a size applied at the same level but containing no lanolin in Table 19.

TABLE 19

CST Sizing Data (Neutral green ink to 80% reflectance)

| Amount Lanolin in AKD | Size (sec) | Δ Size (%) | Sizing Promotion Efficiency |
|---|---|---|---|
| 0% | 36 | 0 | — |
| 0.5% | 278 | 672 | 1344 |
| 3% | 494 | 1272 | 424 |

Example 19

Sizing With Stearic Anhydride/ASA Emulsions

About 18.144 g of ASA-1 was placed in a 100 mL, 3-neck round-bottom flask with one of the following approximate amounts of stearic anhydride: 0.091, 0.182, 0.364 or 0.728 g of stearic anhydride. The stearic anhydride was obtained from Aldrich. The resulting mixture was heated to 75–80° C. to dissolve the stearic anhydride, poured into either a laboratory blender or a Ross mixer, as indicated below, then homogenized for about 10 to about 25 minutes. During this time, air was entrained into the solutions. The solution temperature was observed to increase as shearing was maintained during homogenization. Each solution was allowed to cool to room temperature without further agitation to yield a cloudy liquid containing stearic anhydride at about 0.5, 1.0, 2.0, or 4.0% by weight, respectively, in ASA. In general, the higher the concentration of stearic anhydride the cloudier the cooled solution. However, all of the solutions remained liquid after cooling to room temperature. Infrared spectroscopic analysis of the cooled samples showed that no significant amount of ASA hydrolysis occurred even though homogenization and cooling were not conducted under a nitrogen atmosphere.

Initial sizing emulsions were prepared from each of the above stearic anhydride/ASA sizing agent preparations as an about 1/1 mixture of starch to size by weight, as described in Example 1. The resulting emulsions were used to size handsheets as described in Procedure 4. The handsheets were tested by CST as described in Procedure 2. The data from the CST testing is shown compared to a size applied at the same level but containing no stearic anhydride in Table 20.

TABLE 20

CST Sizing Data (Neutral green ink to 80% reflectance)

| Amount Stearic Anhydride in ASA | Size (sec) | Δ Size (%) | Sizing Promotion Efficiency |
|---|---|---|---|
| 0% | 461 | 0 | — |
| 0.5%[1] | 555 | 20 | 40 |
| 1.0%[1] | 473 | 3 | 3 |
| 2.0%[2] | 580 | 26 | 13 |
| 2.0%[1] | 509 | 10 | 5 |
| 4.0%[1] | 463 | 0 | 0.004 |

[1]Mixed with a laboratory blender at low speed.
[2]Mixed with a Ross mixer at high speed.

All concentrations herein are by weight unless otherwise noted. In compositions comprising at least one sizing agent, all concentrations herein are by weight based on the total weight of all of the sizing agents unless otherwise noted.

Variations of the present invention will suggest themselves to those skilled in this art in light of the above detailed description. Variations and modifications to the compositions and methods of the instant invention can be made by one skilled in the art without departing from the spirit or scope of the invention as defined in the claims set forth below.

What is claimed is:

1. A method for sizing paper products, the method comprising:

forming the paper sizing composition comprised of at least one sizing agent selected from the group consisting of ASA, AKD and rosin wherein the at least one sizing agent is emulsified in water, at least one emulsion stabilizer, and from about 0.01% to about 15% by weight of at least one hydrophobic substance, based on the total weight of sizing agent present, wherein the sizing promotion efficiency of the paper sizing composition as determined by at least one method selected from the group consisting of the Cytec size testing method, the Hercules size testing method, and the Cobb size testing method is greater than or equal to about 4, with the proviso that the hydrophobic substance is not highly alkoxylated, dispersing the composition throughout a paper stock, and optionally forming a web from the paper stock on a paper making machine to form a sized paper product.

2. The method of claim 1, further comprising passing the sized paper product through a drying stage.

3. A method for sizing paper products, the method comprising:

forming the paper sizing composition comprised of at least one sizing agent selected from the group consisting of ASA, AKD and rosin wherein the at least one sizing agent is emulsified in water, at least one emulsion stabilizer, and from about 0.01% to about 15% by weight of lanolin, based on the total weight of sizing agent present, with the proviso that the lanolin is not highly alkoxylated, wherein the sizing promotion efficiency of the paper sizing composition as determined by at least one method selected from the group consisting of the Cytec size testing method, the Hercules size testing method, and the Cobb size testing method is greater than or equal to about 10, and wherein the sizing agent is selected from the group consisting of ASA, AKD, rosin, and mixtures thereof wherein each sizing agent, independently, has an alkyl or alkenyl group comprising form about 8 to about 36 carbon atoms, dispersing the composition throughout a paper stock, and optionally forming a web from the paper stock on a paper making machine to form a sized paper product.

4. The method of claim 3, further comprising passing the sized paper product through a drying stage.

5. A paper or paperboard treated with the sizing composition comprised of at least one sizing agent selected from the group consisting of ASA, AKD and rosin wherein the at least one sizing agent is emulsified in water, at least one emulsion stabilizer, and from about 0.01% to about 15% by weight of at least one hydrophobic substance, based on the total weight of sizing agent present, wherein the sizing promotion efficiency of the paper sizing composition as determined by at least one method selected from the group consisting of the Cytec size testing method, the Hercules size testing method, and the Cobb size testing method is greater than or equal to about 4, with the proviso that the hydrophobic substance is not highly alkoxylated.

6. A paper or paperboard treated with the sizing composition comprised of at least one sizing agent selected from the group consisting of ASA, AKD and rosin wherein the at least one sizing agent is emulsified in water, at least one emulsion stabilizer, and from about 0.01% to about 15% by weight of at least one hydrophobic substance, based on the total weight of sizing agent present, wherein the sizing promotion efficiency of the paper sizing composition as determined by at least one method selected from the group consisting of the Cytec size testing method, the Hercules size testing method, and the Cobb size testing method is greater than or equal to about 4, and wherein the hydrophobic substance is selected from the group containing from about 7 to about 41 carbon atoms, which are optionally monounsaturated or diunsaturated and, whether unsaturated or not, are optionally substituted with at least one hydroxy group, triglycerides comprising aliphatic fatty acid portions containing form about 4 to about 22 carbon atoms, which are optionally monounsaturated or diunsaturated and, whether unsaturated or not, are optionally substituted with at least one hydroxy group, substantially straight chain hydrocarbons containing form about 6 to about 34 carbon atoms, which are optionally terminally unsaturated and, if unsaturated, are optionally isomerized, ASA derivatives formed from the reaction products of about 1 mole of ASA with about 1 mole of 1-octadecanol or 1-hexadecylamine, about 0.2 moles cholesterol or about 1 mole cholesterol, and the reaction products of about 9.25 or of about 3 moles ASA with about 1 mole castor oil, poly(dimethylsiloxane) optionally comprising side chains selected from PEO, PPO, and mixtures thereof, poly(diphenylsiloxane), poly (methylphenylsiloxane), poly(t-butyl-methylsiloxane), poly (dimethylsiloxane-co-alkylmethylsiloxane) where the alkyl comprises, independently, from about 1 to about 18 carbon atoms, poly[dimethylsiloxane-co-3-(aminopropylmethylsiloxane)], hydride-terminated poly(dimethylsiloxane), distearate-terminated poly(dimethylsiloxane), aloe-emodin, aloin, cholesterol, lanosterol, and mixtures thereof, with the proviso that the hydrophobic substance is not highly alkoxylated.

7. A paper or paperboard treated with the sizing composition comprised of at least one sizing agent selected from the group consisting of ASA, AKD and rosin wherein the at least one sizing agent is emulsified in water, at least one emulsion stabilizer, and from about 0.01% to about 15% by weight of lanolin, based on the total weight of sizing agent present, with the proviso that the lanolin is not highly alkoxylated, wherein the sizing promotion efficiency of the paper sizing composition as determined by at least one method selected from the group consisting of the Cytec size testing method, the Hercules size testing method, and the Cobb size testing method is greater than or equal to about 10, and wherein the sizing agent is selected from the group consisting of ASA, AKD, rosin, and mixtures thereof wherein each sizing agent, independently, has an alkyl or alkenyl group comprising form about 8 to about 36 carbon atoms.

* * * * *